US011802424B2

(12) United States Patent
Meuters et al.

(10) Patent No.: US 11,802,424 B2
(45) Date of Patent: Oct. 31, 2023

(54) MOTOR-VEHICLE DOOR LOCK

(71) Applicant: Kiekert AG, Heiligenhaus (DE)

(72) Inventors: Stephan Meuters, Korschenbroich (DE); Jianfeng Wang, Ratingen (DE); Chao He, Mettman (DE)

(73) Assignee: Kiekert AG, Heiligenhaus (DE)

( * ) Notice: Subject to any disclaimer, the term of this patent is extended or adjusted under 35 U.S.C. 154(b) by 338 days.

(21) Appl. No.: 17/251,918

(22) PCT Filed: Jun. 6, 2019

(86) PCT No.: PCT/DE2019/100513
§ 371 (c)(1),
(2) Date: Jan. 28, 2021

(87) PCT Pub. No.: WO2019/238168
PCT Pub. Date: Dec. 19, 2019

(65) Prior Publication Data

US 2022/0235587 A1 Jul. 28, 2022

(30) Foreign Application Priority Data

Jun. 13, 2018 (DE) ..... 10 2018 114 082.7

(51) Int. Cl.
*E05B 77/06* (2014.01)
*E05B 85/24* (2014.01)
(Continued)

(52) U.S. Cl.
CPC ..... *E05B 77/06* (2013.01); *E05B 77/38* (2013.01); *E05B 85/243* (2013.01); *E05B 85/26* (2013.01)

(58) Field of Classification Search
CPC ..... E05B 77/02; E05B 77/04; E05B 77/06; E05B 77/36; E05B 77/38; E05B 77/40;
(Continued)

(56) References Cited

U.S. PATENT DOCUMENTS 4,756,564 A * 7/1988 Ikeda ..... E05B 85/26 292/216
4,783,103 A * 11/1988 Schlegel ..... E05B 85/26 292/216
(Continued)

FOREIGN PATENT DOCUMENTS

DE 10131978 A1 1/2003
DE 10216313 A1 * 10/2003 ..... E05B 77/38
(Continued)

OTHER PUBLICATIONS

Computer Generated Translation for DE102004021516A1, Generated on Jan. 11, 2023, https://worldwide.espacenet.com/ (Year: 2023).*
(Continued)

*Primary Examiner* — Alyson M Merlino
(74) *Attorney, Agent, or Firm* — Renner, Otto, Boisselle & Sklar, LLP

(57) ABSTRACT

A motor vehicle door lock comprising a locking mechanism that essentially consists of a rotary latch and a pawl. In addition, a lock retainer interacting with the locking mechanism is produced, which is introduced into the locking mechanism in order to achieve the closed position and rests on a load arm of the rotary latch in the closed position of the locking mechanism. According to the invention, the load arm is provided with a force deflection contour for the lock retainer. The force deflection contour changes a force direction acting on the load arm from the lock retainer, at least in the event of an excessive impact of the lock retainer.

13 Claims, 2 Drawing Sheets

(51) Int. Cl.
*E05B 77/38* (2014.01)
*E05B 85/26* (2014.01)

(58) Field of Classification Search
CPC ..... E05B 77/42; E05B 85/20; E05B 85/24; E05B 85/243; E05B 85/26; Y10T 292/1047; Y10T 292/1082; Y10S 292/22; Y10S 292/23; Y10S 292/38; Y10S 292/56; Y10S 292/57; Y10S 292/65; Y10S 292/73
See application file for complete search history.

(56) References Cited

U.S. PATENT DOCUMENTS 5,642,636 A * 7/1997 Mitsui ..... E05B 77/40 292/201
6,695,362 B2 * 2/2004 Kluting ..... E05B 77/02 292/216
7,320,488 B2 * 1/2008 Hidding ..... E05B 85/243 292/216
7,467,816 B2 * 12/2008 Nakagawa ..... E05B 77/38 292/216
8,342,605 B2 * 1/2013 Tanaka ..... B60N 2/366 297/216.13
8,727,443 B2 * 5/2014 Vedder ..... E05B 77/04 297/335
9,039,089 B2 * 5/2015 Ohba ..... B60N 2/366 297/335
2005/0156447 A1 * 7/2005 Bishop ..... E05B 77/38 296/193.11

FOREIGN PATENT DOCUMENTS

DE 102004021516 A1 * 11/2005 ..... E05B 77/02
DE 102004021516 A1 11/2005
DE 102005016488 A1 10/2006
DE 102007045224 A1 2/2008
DE 102008035389 A1 * 2/2010 ..... E05B 77/26
DE 102008037213 A1 * 2/2010 ..... E05B 85/045
DE 102009029020 A1 * 3/2011 ..... E05B 77/38
DE 102010011322 A1 * 9/2011 ..... E05B 77/40
DE 102010023904 A1 12/2011
DE 102012021702 A1 * 3/2014 ..... E05B 85/243
EP 628682 A1 * 12/1994 ..... E05B 77/40
EP 1619329 A1 1/2006

OTHER PUBLICATIONS

Computer Generated Translation for DE10216313A1, Generated on Jan. 11, 2023, https://worldwide.espacenet.com/ (Year: 2023).*
Translation of International Search Report dated Sep. 25, 2019, for International Patent Application No. PCT/DE2019/100513.

* cited by examiner

MOTOR-VEHICLE DOOR LOCK

FIELD OF DISCLOSURE

The invention relates to a motor vehicle door lock comprising a locking mechanism that essentially consists of a rotary latch and a pawl, and comprising a lock retainer interacting with the locking mechanism, which is introduced into the locking mechanism in the closing direction in order to achieve the closed position and rests on a load arm of the rotary latch in the closed position of the locking mechanism.

BACKGROUND OF DISCLOSURE

A motor vehicle door lock of the structure described above is presented, for example, in DE 101 31 978 A1. A specially designed load arm is implemented here, which has a window-like opening that promotes plastic deformation when the load is increased. As a result, even high loading forces acting on the rotary latch should not lead to the rotary latch becoming functional.

The state of the art according to DE 10 2004 021 516 A1, which is also generic, deals with a locking device in a vehicle, which can be used, for example, for a vehicle seat. In this case, a rotary latch is implemented that is provided with a soft body. The soft body can be deformed by the action of a counter element or lock retainer. The deformation of the soft body takes place in particular in the event of a crash, with the associated partial displacement of the soft body corresponding to the fact that the counter element or lock retainer rests on the load arm. In this way, a lower opening moment or a closing moment is exerted on the rotary latch overall.

DE 10 2007 045 224 A1 concerns a vehicle door lock comprising a rotary latch which engages in a locking pin when a vehicle door is closed. When the vehicle door is closed, the rotary latch is locked by a pawl and supported on the locking bolt. The rotary latch is provided with a plastic coating. In addition, the rotary latch partially comprises a contact region with the locking pin via a wear-resistant insert which is introduced into or applied to the plastic casing. This is intended to counteract a high level of stress on the plastic coating.

The state of the art has proven itself in principle. However, scenarios are still conceivable, in particular when the lock is not fully closed, in which the lock retainer exerts such high forces on the rotary latch, for example in the event of a crash, that the locking mechanism is opened unintentionally. In the state of the art, there are various approaches to compensate for or control such vehicle states. In the simplest case, at least the load arm of the rotary latch or the rotary latch as a whole is reinforced for this purpose. This can be done by using special materials or through a generally increased use of materials in order to increase the overall static strength under load, especially in the transverse direction.

In recent times, however, increasing demands have been placed on motor vehicle door locks which, on the one hand, aim at unchanged safe operation, but on the other hand, at the same time, demand a solution that is as inexpensive and compact as possible. In addition, weight optimizations are currently being pursued. With regard to these opposing requirements and trends, the state of the art has so far not been able to provide any convincing solutions. Here, the invention aims to provide a total remedy.

SUMMARY OF DISCLOSURE

The invention addresses the technical problem of developing such a motor vehicle door lock in such a way that, with unchanged safety and in particular in avoiding that locking mechanisms are opened accidentally, increased requirements in terms of cost and installation space optimization are met and at the same time a variant that is favorable in terms of weight is propagated.

To solve this technical problem, a generic motor vehicle door lock is characterized within the scope of the invention in that the load arm of the rotary latch is provided with a force deflection contour for the lock retainer. The force deflection contour is designed in such a way that it changes a force direction acting on the load arm from the lock retainer, at least in the event of an excessive impact of the lock retainer. Such an excessive impact is generally observed in the event of a crash, for example in the event of a side impact, and corresponds to the fact that considerable opening forces act on the motor vehicle door lock.

As soon as there is an excessive impact of the lock retainer in the closed position of the locking mechanism, the interaction of the lock retainer with the force deflection contour on the load arm of the rotary latch according to the invention ensures that the force and in particular the force direction acting on the load arm from the lock retainer changes. The force deflection contour on the load arm of the rotary latch ensures the change in the force direction and interacts with the lock retainer in the corresponding sense at least in the event of an excessive impact of the lock retainer.

In detail, the force deflection contour is provided with a lug for this purpose. When the lock retainer is moved in the opening direction of the rotary latch, the lug interacts with the lock retainer. The described movement of the lock retainer in the opening direction of the rotary latch typically takes place in the event of an excessive impact of the lock retainer in the event of a crash.

In detail, the procedure can be such that the lug as a component of the force deflection contour changes its force vector acting on the rotary latch, i.e. the force vector of the lock retainer with which it acts on the rotary latch, when the lock retainer rests (as a result of the excessive impact of the lock retainer). The change in the force vector of the lock retainer generally takes place in its closing direction or generally in its direction of movement. The direction of movement belongs to the opening or closing direction of the lock retainer. This means that as soon as there is an excessive impact of the lock retainer, the lock retainer can interact with the lug of the force deflection contour on the load arm of the rotary latch. The interaction of the lock retainer with the lug as a result of the lock retainer resting on the lug ensures that the force exerted by the lock retainer on the load arm and consequently the rotary latch changes. The change in force is accompanied by the fact that the direction of the force vector acting on the rotary latch from the lock retainer changes.

In fact, in this scenario, the force vector is initially oriented in such a way that, in the described closed position of the locking mechanism and when it rests on the load arm of the rotary latch, it acts on the rotary latch in its opening direction. However, the resting of the lock retainer on the lug of the force deflection contour when it experiences an excessive impact now leads to the fact that the force vector, initially oriented in the opening direction of the rotary latch, of the force exerted by the lock retainer on the load arm is changed in the closing direction or direction of movement of the lock retainer.

Since the closing direction or direction of movement of the lock retainer is close to an axis of the rotary latch, whereas the original direction of the force vector of the lock retainer for opening the rotary latch is oriented away from the said axis of the rotary latch, the described change in the force vector of the lock retainer is also accompanied by a significant reduction in the torque applied to the rotary latch and exerted with the aid of the lock retainer. In fact, the change in the direction of the force vector of the lock retainer corresponds to the fact that typically the distance from the origin of the force vector or the center of a locking pin as a component of the lock retainer is roughly halved or even further reduced compared to the axis of the rotary latch, so that as a consequence, at least a halving of the torque can be expected.

As a result, the special force deflection contour formed on the load arm of the rotary latch with the lug ensures that the torque exerted by the lock retainer on the rotary latch in the closed position of the locking mechanism is at least halved compared to the state of the art in the event of an excessive impact of the lock retainer in the opening direction of the locking mechanism according to the invention. According to the invention, the described minimum torque halving is associated with the fact that this is brought about purely by geometric measures and neither special procedures for increasing the strength nor additional use of materials are required. As a result, the costs and the weight can be practically the same as in the state of the art and, nevertheless, increased safety is provided. Conversely, in comparison with the state of the art, the use of materials can be reduced when the safety regulations are fulfilled, and consequently the installation space and the outlay on costs can also be reduced. Herein lie the essential advantages.

According to an advantageous embodiment, the lug is designed as a fang. In this context, the fang ensures that when the locking mechanism is in the closed position, an excessive impact of the lock retainer in the direction of opening the locking mechanism in particular does not result in the rotary latch actually being pivoted in the opening direction. Rather, this process results in the lock retainer being moved in the opening direction of the rotary latch and thereby moving counter to the lug or fang. A further relative movement of the lock retainer or its locking pin relative to the load arm is consequently prevented by the fang. At the same time, the fang and the force deflection contour implemented in this way ensure that the force vector of the lock retainer associated with the described and possible opening of the rotary latch experiences the decisive change in direction. This will be explained in more detail with reference to the description of the figures.

The rotary latch is generally provided with a casing. In addition, the design is such that the force deflection contour is embedded in the casing. The casing is generally applied to the otherwise metallic rotary latch by a plastic injection molding process with the rotary latch completely or partially covered. With the aid of the casing, noises from the moving rotary latch in particular are suppressed or damped.

This means that the casing damps movements of the lock retainer relative to the load arm during normal operation. This also applies to the region of the force deflection contour. As long as the locking mechanism and the lock retainer are acted upon in normal operation, the casing ensures that the rotary latch is initially transferred from its pre-closed position or pre-ratchet position to the main closed position or main ratchet position when the lock retainer moves into the locking mechanism in the closing direction. For this purpose, the locking pin, as a component of the lock retainer, moves counter to a ratchet arm which is opposite the load arm of the rotary latch. In this context, the casing ensures, as desired, that the movement of the lock retainer relative to the rotary latch is damped and that any noises associated with the closing process are minimized as desired. In the closed position of the locking mechanism, the locking pin rests on the ratchet arm or the load arm or both.

If, on the other hand, emergency operation occurs, the lock retainer acts primarily on the load arm in the closed position of the locking mechanism and the casing regularly gives way the lock retainer. In emergency operation and when the locking mechanism is in the closed position, the pawl has generally only engaged in a pre-ratchet of the rotary latch. In this pre-closed position or pre-ratchet position of the locking mechanism, excessive forces acting on the lock retainer and directed in the opening direction run the risk of the rotary latch being opened unintentionally or the load arm being deformed in the opening direction.

In the emergency operation in question, the casing of the load arm gives way to the lock retainer. In this way, the lock retainer or the locking bolt as a component of the lock retainer can interact with the force deflection contour, which only comes and can only come into engagement with the lock retainer or the locking pin by the casing giving way.

The lock retainer is generally bow-shaped with the cylindrical locking pin and designed to interact with the locking mechanism. In addition, the design is typically such that the force deflection contour on the load arm of the rotary latch interacts with the lock retainer only in the pre-closed position of the locking mechanism. Here, the invention is based on the knowledge that the lock retainer or its cylindrical locking pin rests almost tangentially against a stop edge of the load arm of the rotary latch in the pre-closed position of the locking mechanism. If, in this pre-closed position of the locking mechanism, excessive force is applied to the lock retainer in the opening direction of the locking mechanism, there is a risk that the lock retainer or its locking pin will pivot the rotary latch in the opening direction or push it out of the pre-ratchet position. Additionally or alternatively, plastic deformations of the load arm of the rotary latch can occur.

Such scenarios are avoided according to the invention because in the pre-closed position and with the locking pin resting tangentially on the stop edge, excessive force on the lock retainer in the opening direction results in the lock retainer or its locking pin interacting with the force deflection contour in the manner described. The force deflection contour geometrically ensures that during this process the opening torque acting on the rotary latch is at least halved compared to the state of the art, so that neither an unintentional opening of the locking mechanism nor unintentional deformation of the load arm of the rotary latch is to be expected. In contrast, the cylindrical locking pin in the main ratchet position of the locking mechanism is enclosed by the rotary latch over at least half of its circumference, so that the feared slipping or sliding along the stop edge on the load arm is not observed in the pre-ratchet position.

BRIEF DESCRIPTION OF DRAWINGS

The invention is explained in greater detail below with reference to drawings, which show only one embodiment. In the drawings.

DETAILED DESCRIPTION

Figure 1:
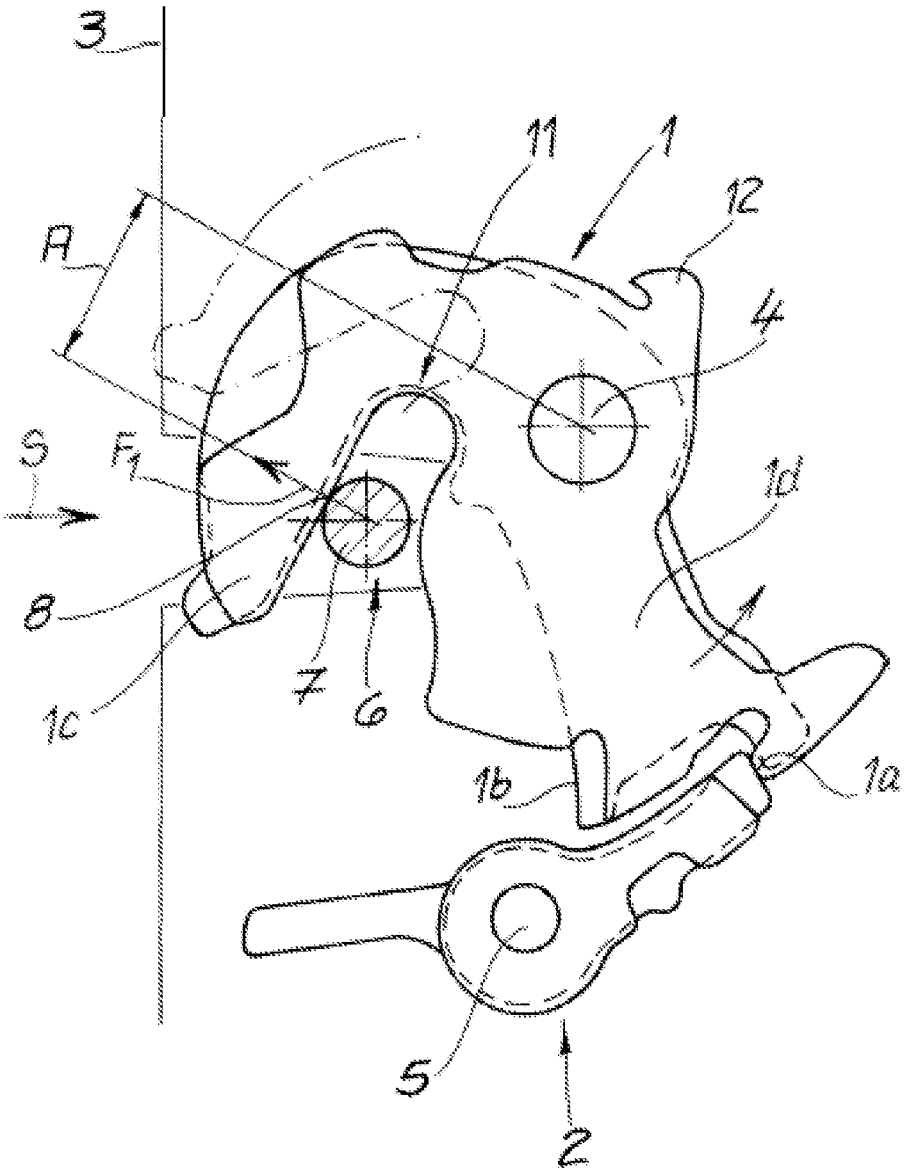
FIG. 1 shows a motor vehicle door lock according to the state of the art and FIG. 2 shows the motor vehicle door lock according to the invention, partially in an enlarged view.

A motor vehicle door lock is shown in the figures. This essentially comprises a locking mechanism 1, 2 that consists of a rotary latch 1 and a pawl 2. The rotary latch 1 and the pawl 2 are each mounted in a lock case 3. For this purpose, the rotary latch 1 has a rotary latch axis 4 and the pawl 2 has a pawl axis 5.

Both axes 4, 5 are defined by bearing pins anchored in the lock case 3. It can be seen that both locking mechanisms 1, 2 and consequently also the associated motor vehicle door locks according to FIGS. 1 and 2 each assume their pre-ratchet position or pre-closed position. In this pre-ratchet position or pre-closed position, the respective pawl 2 has engaged in a pre-ratchet recess 1*a* of the rotary latch 1. The rotary latch 1 also comprises a main ratchet stop 1*b* or a main ratchet recess.

The basic structure also includes a lock retainer 6, 7 interacting with the locking mechanism 1, 2. The lock retainer 6, 7 is composed of a U-shaped bracket and a cylindrical locking pin 7 that extends between the two bracket legs and is shown in schematic section in both FIGS. 1 and 2. The locking pin 7 or the lock retainer 6, 7 interacts as a whole with the locking mechanism 1, 2.

In the exemplary embodiment, the lock retainer 6, 7 may be connected to a motor vehicle body, whereas the motor vehicle door lock and with it the locking mechanism 1, 2 are located inside a motor vehicle door (not shown). As soon as the motor vehicle door is closed, the lock retainer 6, 7 is introduced into the locking mechanism 1, 2, in each case in the closing direction S indicated by an arrow in FIGS. 1 and 2. The opposite direction to the closing direction S denotes the opening direction of the lock retainer 6, 7. Both directions define a total direction of movement of the lock retainer 6, 7.

During this closing process and consequently the movement of the lock retainer 6, 7 in the illustrated closing direction S, the locking pin 7 of the lock retainer 6, 7 ensures that the rotary latch 1 is pivoted counterclockwise about its rotary latch axis 4 starting from an open position indicated in FIG. 1. As soon as the rotary latch 1 has achieved the pre-ratchet position or pre-closed position shown in FIGS. 1 and 2 in this way, the pawl 2 can engage in the associated pre-ratchet recess 1*a* of the rotary latch 1. A movement of the pawl 2 about its pawl axis 5, supported for example by a spring, also corresponds to this in the counterclockwise direction.

Figure 2:
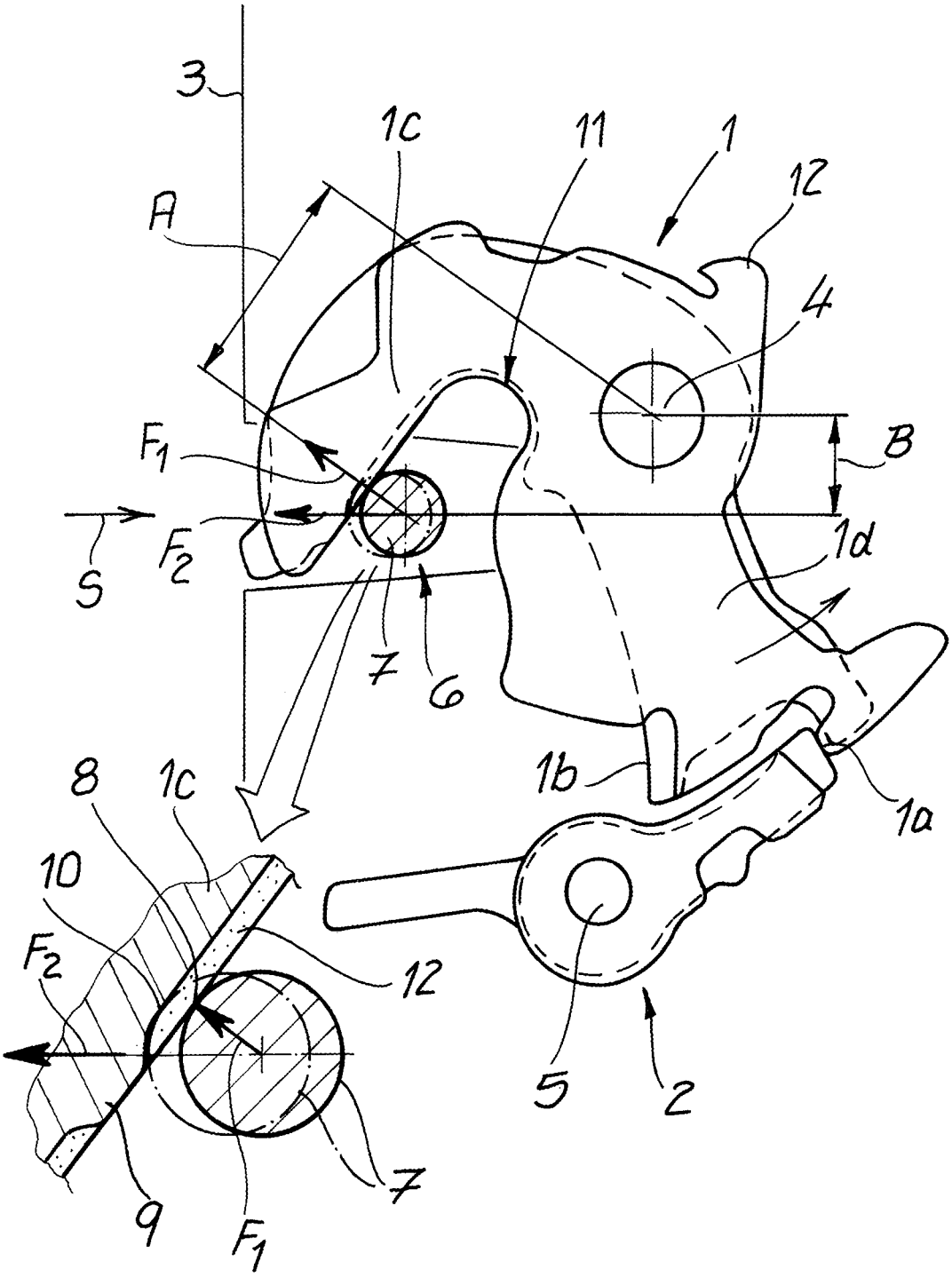

With a further movement of the lock retainer 6, 7 in the illustrated closing direction S, the rotary latch 1 is pivoted further counterclockwise about its rotary latch axis 4, starting from the pre-ratchet position according to FIGS. 1 and 2, until it has reached the main ratchet position or main closed position. In this case, the pawl 2 engages in the main ratchet or moves counter to the main ratchet or the main ratchet stop 1*b* of the rotary latch 1. This is indicated by an arrow in FIG. 1.

In the closed position or pre-closed position or pre-ratchet position of the locking mechanism 1, 2 shown in FIGS. 1 and 2, the lock retainer 6, 7 or its locking pin 7 rests on a load arm 1*c* of the rotary latch 1. In addition to the load arm 1*c*, the rotary latch 1 also comprises a ratchet arm 1*d*, which interacts with the pawl 2. If, in this pre-closed position or pre-ratchet position, the lock retainer 6, 7 is subjected to an excessive impact in the opening direction, for example as a result of a side impact, i.e. counter to the closing direction S indicated by the arrow, the locking pin 7 acts on the load arm 1*c* of the rotary latch 1.

In the event of an excessive impact of the lock retainer 6, 7 in the opening direction of the locking mechanism 1, 2, which can be observed in the pre-closed position, the almost tangential resting of the cylindrical locking pin 7 against a stop edge 8 on the load arm 1*c* of the rotary latch 1 ensures that the locking pin 7 or the lock retainer 6, 7 is moved in the opening direction of the rotary latch 1. This is explained as follows.

Due to the tangential resting of the cylindrical locking pin 7 on the inclined stop edge 8, the force acting on the lock retainer 6, 7 in the opening direction acts on the stop edge 8 in such a way that the associated force vector $F_1$ shown in FIG. 1, starting from a center point of the locking pin 7, engages perpendicularly or normally to the inclined or tangential stop edge 8 on the rotary latch 1 or the load arm 1*c*. The force vector $F_1$ acting on the rotary latch 1 in this way ensures that a torque is applied to the rotary latch 1 in the opening direction, which is composed of the vector product of the force on the locking bolt 7 or lock retainer 6, 7 and the distance A of the force vector $F_1$ from a distance line parallel through the center of the rotary latch axis 4. This is indicated in FIG. 1 by the relevant distance A.

The application of torque in the opening direction of the rotary latch 1, i.e. in the direction of a clockwise movement about the rotary latch axis 4, results from the fact that the force vector $F_1$ encloses an acute angle with the closing direction S or the general direction of movement of the locking mechanism 1, 2 or lock retainer 6, 7 and at the same time the force vector $F_1$ is oriented clockwise, i.e. in the opening direction of the rotary latch 1, pivoted away from the closing direction S. This applies to a motor vehicle door lock according to the state of the art, as shown in FIG. 1.

In contrast, FIG. 2 shows a motor vehicle door lock according to the invention. This is characterized in that the load arm 1*c* of the rotary latch 1 is provided with a force deflection contour 9, 10 which can be seen in particular in the enlarged detailed view. The force deflection contour 9, 10 interacts with the lock retainer 6, 7, but in the context of the exemplary embodiment only and exclusively in the event of an excessive impact of the lock retainer 6, 7 and only when the locking mechanism 1, 2 is in the pre-closed or pre-ratchet position shown in FIG. 2. If, on the other hand, the locking mechanism 1, 2 assumes the main ratchet position or main closed position (not shown), the cylindrical locking pin 7 is then accommodated and enclosed practically over at least half of its circumference by a contour 11 at the end of a fork jaw accommodating the locking pin 7 inside the rotary latch 1. In the main ratchet position or main closed position, unintentional opening of the locking mechanism 1, 2 without its destruction is consequently not possible. The fork jaw adjusts itself automatically between the load arm 1*c* and the ratchet arm 1*d* because the two arms 1*c*, 1*d* are spaced apart from one another.

The force deflection contour 9, 10 on the load arm 1*c* of the rotary latch 1 is only implemented in the motor vehicle door lock according to the invention according to FIG. 2, but not in the motor vehicle door lock according to the state of the art, as shown in FIG. 1. The load arm 1*c* of the rotary latch 1 provided with the force deflection contour 9, 10 in this way ensures that a force direction or force $F_1$ acting on the load arm 1*c* from the lock retainer 6, 7 changes the force direction at least in the event of an excessive impact of the lock retainer 6, 7 in the opening direction of the locking mechanism 1, 2.

Applied to the specific exemplary embodiment, this means that the opening force on the lock retainer 6, 7 without a force deflection contour 9, 10 according to the state of the art according to FIG. 1 corresponds to the force vector $F_1$, whereas the force deflection contour 9, 10 in the motor vehicle door lock according to the invention according to FIG. 2 results in the force vector $F_2$ deviating from the opening force acting on the lock retainer 6, 7.

For this purpose, the force deflection contour 9, 10 is provided with a lug 9. In addition, the force deflection contour 9, 10 has a run-up edge 10, as evidenced by the enlarged view. The lug 9 ensures that the lock retainer 6, 7 moved in the opening direction of the rotary latch 1 interacts with the lug 9. The run-up edge 10 corresponds to the stop edge 8.

In fact, an excessive force on the lock retainer 6, 7 in the opening direction in the motor vehicle door lock according to the invention according to FIG. 2 initially leads to the force direction $F_1$ being established. This is because the cylindrical locking pin 7 again rests tangentially against the stop edge 8 during this process. The stop edge 8 is defined according to the exemplary embodiment and not in a limiting manner by a casing 12 of the rotary latch 1. In fact, the rotary latch 1 is predominantly encased by the casing 12 in question, which is applied to the rotary latch 1 in the course of a plastic injection molding process. In the region of the stop edge 8, the force deflection contour 9, 10 is embedded in the casing 12, as the schematic and enlarged sectional view in FIG. 2 makes clear.

In normal operation, the casing 12 ensures that movements of the lock retainer 6, 7 and consequently its locking pin 7 relative to the load arm 1*c* of the rotary latch 1 are damped. As long as the conditions for normal operation prevail, during the closing process and when the lock retainer 6, 7 moves into the fork recess or fork jaw of the rotary latch 1, the rotary latch 1 is pivoted counterclockwise about the rotary latch axis 4 as described from its open position beyond the pre-ratchet position shown in FIG. 2 until it reaches the main closed position or main ratchet position.

If, on the other hand, emergency operation occurs in the pre-ratchet position or pre-closed position of the locking mechanism 1, 2 in the motor vehicle door lock according to the invention according to FIG. 2, the casing 12 initially gives way to the lock retainer 6, 7 or its locking pin 7. The locking pin 7 can consequently penetrate into the casing 12, as represented by a dot-dash line in FIG. 2. The force vector $F_1$ corresponds to this because the cylindrical locking pin 7 rests predominantly tangentially on the stop edge 8 and the force vector $F_1$ or a comparable scenario as described with reference to FIG. 1 is thereby established.

As soon as the casing 12 has given way and the locking pin 7 meets the leading edge or run-up edge 10, the movement of the locking pin 7 relative to the load arm 1*c* of the rotary latch 1 ensures that the locking pin 7 is moved in the direction of the lug 9 following the force vector $F_1$ in the illustration according to FIG. 2. This means that the force deflection contour 9, 10 or its lug 9 interacts with the lock retainer 6, 7 moved in the opening direction of the rotary latch 1. This is because the movement of the locking bolt 7 relative to the load arm 1*c* of the rotary latch 1 also means that the rotary latch 1 is acted upon in the opening direction, i.e., clockwise about its rotary latch axis 4.

As soon as the lock retainer 6, 7 or its locking pin 7 interacts with the force deflection contour 9, 10 or the lug 9 designed as a fang, the lug 9 changes the force vector $F_1$ acting on the rotary latch 1 in the closing direction S of the lock retainer 6, 7 when the lock retainer 6, 7 rests. This means that when the locking bolt 7 rests on the lug 9, in contrast to the force vector $F_1$ that is initially formed, the opening force results in a changed force direction and consequently the force vector $F_2$ shown in FIG. 2. The force vector $F_2$ is oriented in the closing direction S of the lock retainer 6, 7 or opposite thereto or generally in its direction of movement. In other words, when the lock holder 6, 7 rests, the lug 9 changes its force vector $F_1$ acting on the rotary latch 1 in the direction of movement of the lock retainer 6, 7, which corresponds to the closing direction S and the opening movement of the locking pin 7 directed opposite thereto. The force vector $F_1$ becomes the force vector $F_2$.

The result of this is that the force vector $F_2$ has a reduced distance B compared to a parallel distance line drawn through the rotary latch axis 4. As a result, a reduced torque is applied to the rotary latch 1 at the same time, namely a torque reduction by at least a factor of 2. This is explained by the fact that the distance A is designed to be more than twice as large as the distance B. This means that due to the geometric design of the load arm 1*c* with the additional force deflection contour 9, 10, the torque acting on the rotary latch 1 in the pre-ratchet position or pre-closed position in the opening direction is almost halved or even further reduced. All of this is possible without additional measures to increase strength.

The invention claimed is:

1. A motor vehicle door lock comprising:

a locking mechanism that includes a rotary latch and a pawl; and a lock retainer interacting with the locking mechanism to achieve a pre-closed position of the locking mechanism and a main closed position of the locking mechanism, wherein the lock retainer rests on a load arm of the rotary latch in the pre-closed position of the locking mechanism, wherein the load arm includes a force deflection contour for the lock retainer which changes direction of a force acting on the load arm from the lock retainer during an excessive impact of the lock retainer with the load arm, the force deflection contour interacts with the lock retainer only in the pre-closed position of the locking mechanism, wherein the lock retainer is spaced from the force deflection contour in the main closed position, wherein the force deflection contour includes a lug, wherein the lug is positioned such that in the pre-closed position the lock retainer does not engage the lug and acts on the load arm of the rotary latch with a first force vector oriented in an opening direction of the rotary latch and during the excessive impact of the lock retainer with the load arm, the lock retainer engages the lug such that the lock retainer acts on the load arm with a second force vector oriented opposite a closing direction of the lock retainer, wherein the second force vector is at an angle with respect to the first force vector.

2. The motor vehicle door lock according to claim 1, wherein the lug is configured as a fang.

3. The motor vehicle door lock according to claim 1, wherein the rotary latch includes a casing.

4. The motor vehicle door lock according to claim 3, wherein the force deflection contour is embedded in the casing.

5. The motor vehicle door lock according to claim 3, wherein the casing damps movements of the lock retainer relative to the load arm in normal operation.

6. The motor vehicle door lock according to claim 3, wherein the casing enables the lock retainer to interact with the force deflection contour during the excessive impact of the lock retainer with the load arm.

7. The motor vehicle door lock according to claim 1, wherein the lock retainer is bow-shaped and includes a cylindrical locking pin for interaction with the locking mechanism.

8. The motor vehicle door lock according to claim 1, wherein the lock retainer includes a cylindrical locking pin.

9. The motor vehicle door lock according to claim 8, wherein during the excessive impact of the lock retainer with the load arm, the cylindrical locking pin rests tangentially on a stop edge of the load arm.

10. The motor vehicle door lock according to claim 1, wherein the rotary latch includes a ratchet arm that interacts with the pawl.

11. The motor vehicle door lock according to claim 10, wherein the lock retainer is received between ratchet arm and the load arm.

12. The motor vehicle door lock according to claim 10, wherein the ratchet arm and the load arm are spaced apart.

13. The motor vehicle door lock according to claim 1, wherein the force deflection contour has a run-up edge.

* * * * *